US008484896B1

(12) United States Patent
Skubiak, Jr.

(10) Patent No.: US 8,484,896 B1
(45) Date of Patent: Jul. 16, 2013

(54) PET ACCESS DOOR FOR MOUNTING ON SCREEN DOORS

(76) Inventor: Stefan Skubiak, Jr., Douglassville, PA (US)

( * ) Notice: Subject to any disclaimer, the term of this patent is extended or adjusted under 35 U.S.C. 154(b) by 106 days.

(21) Appl. No.: 12/839,221

(22) Filed: Jul. 19, 2010

Related U.S. Application Data

(63) Continuation-in-part of application No. 11/695,036, filed on Apr. 1, 2007, now abandoned.

(51) Int. Cl.
*E06B 7/28* (2006.01)

(52) U.S. Cl.
USPC ..... 49/169; 49/163; 160/180; 160/369

(58) Field of Classification Search
USPC ..... 49/169, 170, 163; 119/484; 160/180, 160/369, 90
See application file for complete search history.

(56) References Cited

U.S. PATENT DOCUMENTS

| | | | | |
|---|---|---|---|---|
| 4,754,797 | A | 7/1988 | Sronce | 160/354 |
| 5,117,890 | A | 6/1992 | Taylor et al. | 160/180 |
| 5,535,804 | A | 7/1996 | Guest | 160/180 |
| 5,657,592 | A | 8/1997 | Davlantes | 52/206 |
| 5,701,813 | A | 12/1997 | Smith | 160/180 |
| 2007/0175097 | A1 * | 8/2007 | Thorne et al. | 49/169 |

* cited by examiner

*Primary Examiner* — Gregory Strimbu
(74) *Attorney, Agent, or Firm* — Miller Law Group, PLLC

(57) ABSTRACT

A pet access door assembly mounts on the screen member of an outer screen door in a residential dwelling structure. The pet access door assembly includes a pair of frame members positionable on opposing sides of the screen member to trap the screening material between the frame members. The frame members are provided with both snap pins and removable fasteners that interengage the opposing frame members to place a high clamping load on the screening material between the frame members. A solid pliable door flap is clamped between the frame members by both the snap pins and the fasteners to allow a hinged movement for ingress and egress of the pet. A security panel is selectively mounted in a grooved receptacle on the inner frame member to prevent passage through the pet door assembly. A magnet secures the bottom of the door flap against the security panel.

6 Claims, 4 Drawing Sheets

PET ACCESS DOOR FOR MOUNTING ON SCREEN DOORS

CROSS-REFERENCE TO RELATED APPLICATIONS

This application is a continuation-in-part of U.S. patent application Ser. No. 11/695,036, filed on Apr. 1, 2007, now abandoned.

FIELD OF THE INVENTION

The present invention relates generally to an access door for use by pets for ingress and egress from a dwelling structure and, more particularly, to a pet access door assembly that can be mounted directly on the screen portion of an exterior screen door.

BACKGROUND OF THE INVENTION

Dogs and cats are the most popular pets in homes. These pets often require access to the outdoors and pet access doors have been developed to allow these pets to pass through the dwelling door without requiring the dwelling door to be opened for them. Such doors are constructed with a pivoted door supported on a frame that is attached to a dwelling door. Generally, a hole is formed in the dwelling door so that the frame of the pet access door can be mounted to the dwelling door for support of the pivoted pet access door. None of the known pet access doors provide an effective mounting on the screen portion of an exterior screened door. Screens are formed by interwoven, but small and delicate wires that do not provide much support strength for mounting structure thereon.

The pet access door disclosed in U.S. Pat. No. 5,117,890, granted to Robert Taylor on Jun. 2, 1992, is mountable on the screen portion of an exterior screen door. The Taylor pet access door includes a frame member mounted on opposing sides of the screen through adhesives to provide a seal against the screen. The frame members are interconnected by a single pin at the top and also at the bottom of the frame to align the frames. The door member in Taylor is provided by a flexible screen member that is clamped between the opposing frame members at the top of the assembly. The durability of the flexible flap is questionable as the pivoting is provided by the flexible nature of the screen member clamped between the opposing frames. Furthermore, Taylor provides no security feature to prevent the flexible flap from being opened.

U.S. Pat. No. 5,535,804 granted on Jul. 16, 1996 to Robert Guest discloses a pet access door that can be mounted on a screen door. The Guest pet access door includes a pair of opposing frame members that are fastened through a plurality of pins extending around the perimeter of the frame members that are received in bores on the opposing frame member for a force fit acceptance of the pins. The enclosed portion of the screen member is captured in a subframe member and cut along three sides so that the enclosed screen member is flexibly movable about the fourth side at the top of the assembly. As with the Taylor disclosure, the durability of such an arrangement is questionable. The Guest pet access door incorporates a magnetic latch device and a movable locking tab that secures the subframe enclosing the screen member against the frame to provide security for the pet access door.

The pet access door disclosed in U.S. Pat. No. 5,701,813 granted to John Smith on Dec. 30, 1997, is mounted on one side of the screen at the corner of the screen door to utilize the frame of the screen door as support for the pet door assembly.

The screen member is captured into a spline groove formed in the frame of the pet access door. The door flap is formed of flexible material, such as vinyl or rubber, mounted on the side of the frame to provide a hinged operation without establishing a specific pivot axis. No security feature to limit the opening of the door flap is disclosed.

A substantial pet access door assembly is taught in U.S. Pat. No. 5,657,592, issued to George Davlantes on Aug. 19, 1997, for mounting on a solid and substantial outer door of a dwelling structure. The frame members in Davlantes are very large, and even though formed of injection molded plastic would be too heavy to be utilized on a screen door, as the frame members need to be supported from and directly on the screen member. The Davlantes pet access door teaches a security cover that is positionable within an opening in the frame members to secure the opening from unwanted operation of the door flap. Similarly, the pet access door disclosed in U.S. Pat. No. 4,754,797, granted to Robert Sronce on Jul. 5, 1988, is a heavy assembly that is not adapted for mounting on a screen door.

It would be desirable to provide a pet access door assembly that would be effective in mounting on the screen portion of an outer screen door of a dwelling structure while allowing for a security panel that would prevent operation of the door flap.

SUMMARY OF THE INVENTION

It is an object of this invention to overcome the disadvantages of the prior art by providing a pet access door assembly adapted to be mounted on the screen portion of an outer screen door or a dwelling structure.

It is another object of this invention to provide in a pet access door a door flap that is supported by the frame members of the pet access door.

It is a feature of this invention that the frame members are provided with snap pins that will extend through the woven screen member to engage openings in the opposing frame member to attaché the two frame members on opposing sides of the screen member.

It is another feature of this invention that the frame members are also provided with fasteners that interengage the opposing frame members of the pet access door in addition to the snap pins.

It is an advantage of this invention that the utilization of fasteners and snap pins allows a high clamping load to be distributed around the woven screen member to secure the pet door frame members to the screen.

It is another advantage of this invention that the entire pet access door can be mounted to the screen member of an outer screen door without damaging or modifying the frame of the outer screen door.

It is still another feature of this invention that the pet access door includes a vertically slidable security panel that is received within a groove formed on the inner frame member.

It is yet another feature of this invention that the door flap of the pet access door is formed of a solid pliable material hinged through a connection of the door flap between the opposing frame members at the top of the assembly.

It is still another advantage of this invention that the pet is less reluctant to press against the solid pliable door flap than a door flap formed of screen material.

It is yet another advantage of this invention that the frame members of the pet access door assembly are mounted on opposing sides of the screen member to clamp the screen material between the frame members.

It is still another feature of this invention that the pliable door flap is formed with a magnet at the bottom portion thereof to be attracted to a corresponding magnet placed on a bottom portion of the security panel.

It is still another advantage of this invention that the door flap will be secured against the security panel when inserted into the inner frame member to prevent operation of the pet door assembly.

It is yet another advantage of this invention that the security panel is slidable into a grooved receiver on the inner frame member.

It is yet another feature of this invention that the door flap is formed with a upper portion that is formed with both openings for the passage of snap pins through the upper portion and holes for the passage of fasteners interconnecting the opposing frame members.

It is another advantage of this invention that the upper portion of the door flap is firmly clamped between the opposing frame members of the pet door assembly.

It is still another object of this invention to provide a pet access door assembly that can be mounted along the entire perimeter to screening material within an outer screen door in a residential structure.

It is yet another object of this invention to provide a pet access door assembly for mounting on a screen member, which is durable in construction, inexpensive of manufacture, carefree of maintenance, facile in assemblage, and simple and effective in use.

These and other objects, features and advantages are accomplished according to the instant invention by providing a pet access door for mounting on the screen member of an outer screen door in a residential dwelling structure. The pet door assembly includes a pair of frame members positionable on opposing sides of the screen member to trap the screening material around the perimeter between the frame members. The frame members are provided with both snap pins and removable fasteners that interengage the opposing frame members to place a high clamping load on the screening material between the frame members. A solid pliable door flap is clamped between the frame members by both the snap pins and the fasteners to allow a hinged movement for ingress and egress of the pet. A security panel is selectively mounted in a grooved receptacle on the inner frame member to prevent passage through the pet door assembly. A magnet secures the bottom of the door flap against the security panel.

BRIEF DESCRIPTION OF THE DRAWINGS

The advantages of this invention will be apparent upon consideration of the following detailed disclosure of the invention, especially when taken in conjunction with the accompanying drawings wherein.

DETAILED DESCRIPTION OF THE PREFERRED EMBODIMENT

Figure 1:
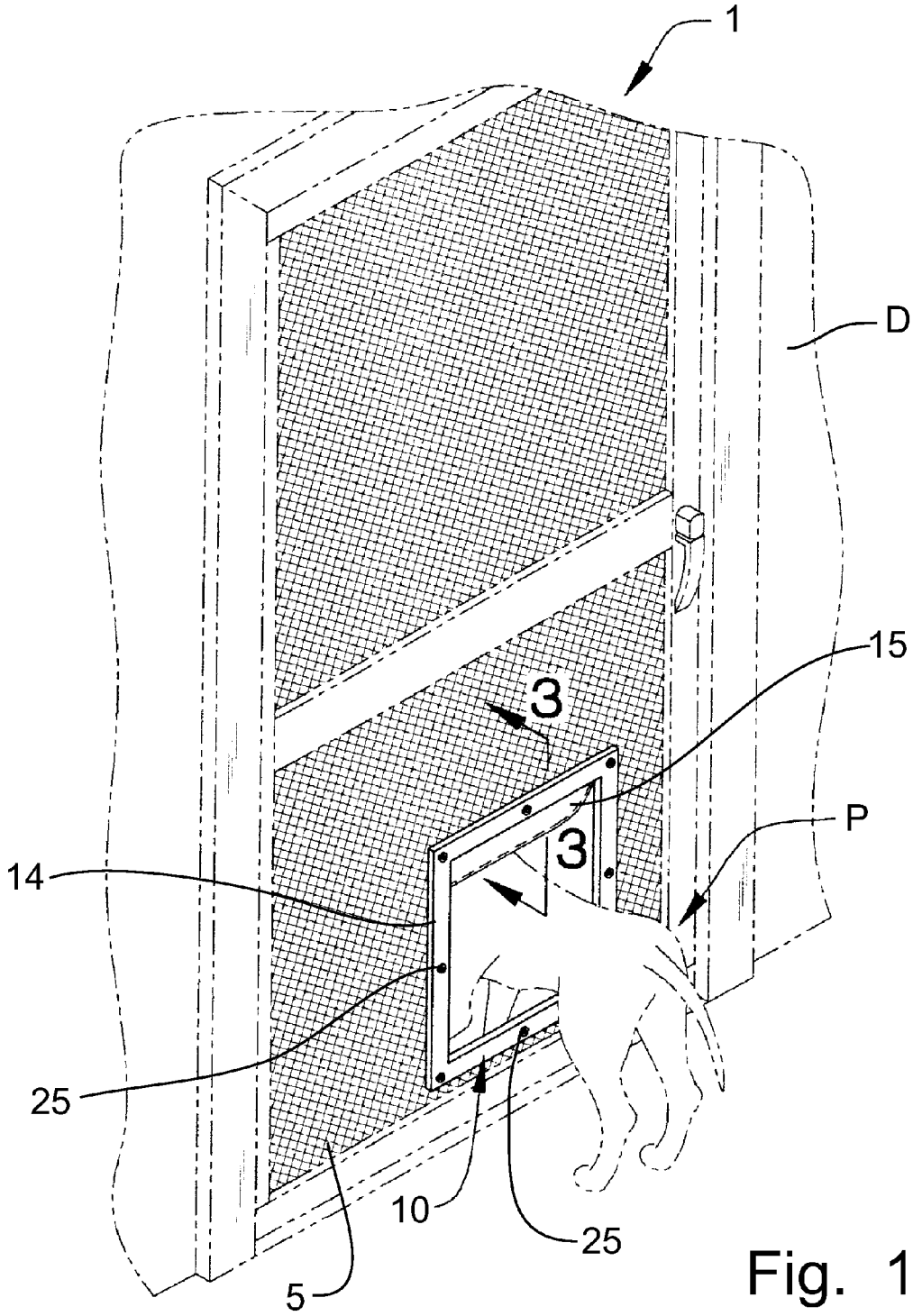
FIG. 1 is a perspective view from an outside viewpoint of a pet access door incorporating the principles of the instant invention, the pet access door is installed on the lower screen member of the outer screen door shown in phantom, a representative pet being shown passing through the pet access door assembly.

Referring now to the drawings, a pet access door assembly incorporating the principles of the instant invention can best be seen. The pet access door 10 is preferably generally rectangularly shaped and configured for mounting on the screen member 5 of an outer screen door 1 of a dwelling structure D for the ingress and egress of a pet P through the door assembly 10. As with conventional pet access doors, the pet pushes against the hinged door flap 15 to displace the door flap 15 and permit passage through the pet access door 10, as will be described in greater detail below.

Figure 2:
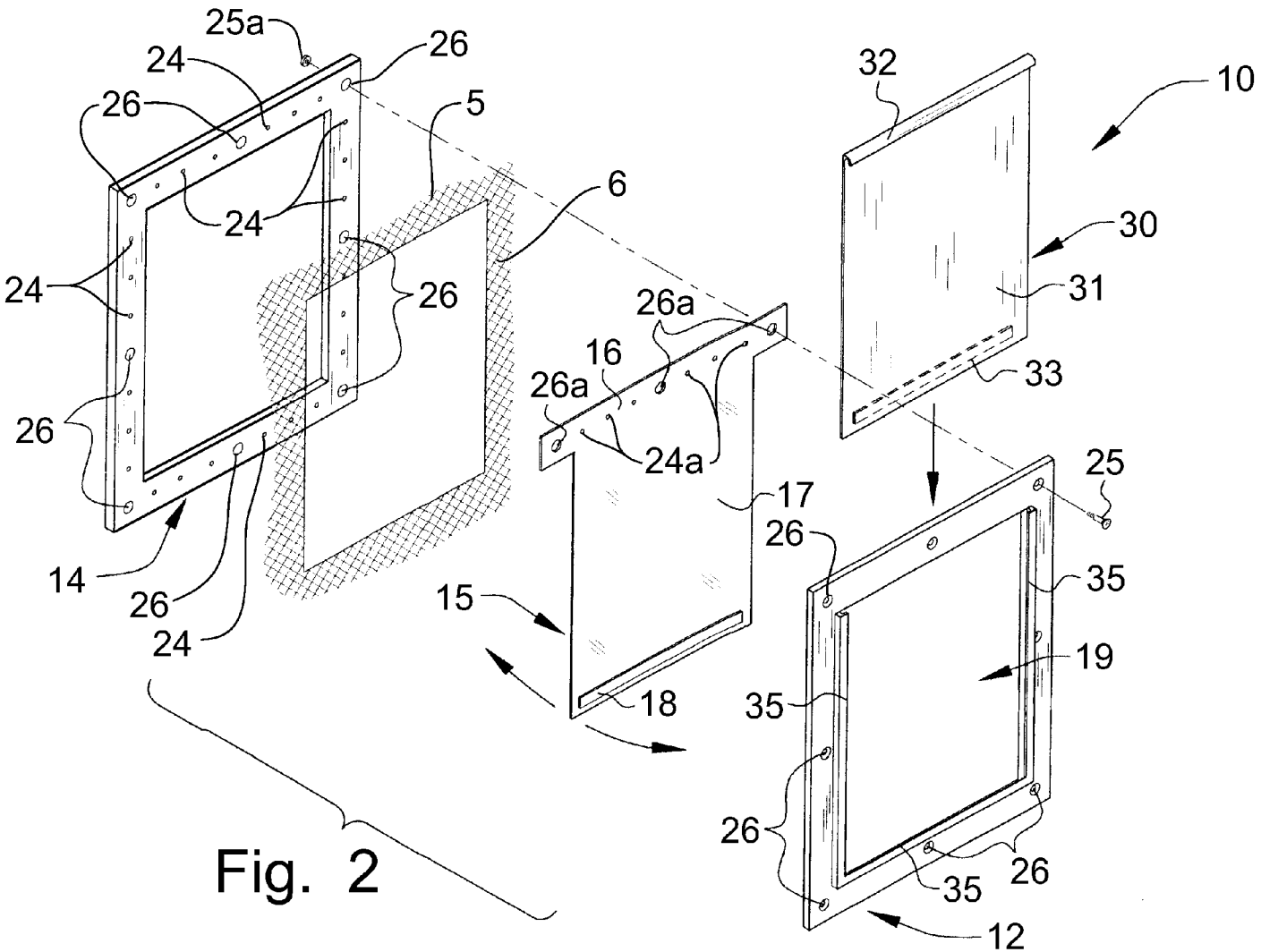
FIG. 2 is an exploded perspective view of the pet access door assembly shown in FIG. 1, including a representative portion of screening material trapped between the opposing frame members, the outer frame member being shown with both snap pin holes and fastener openings for engagement of snap pins formed in the inner frame member and for the passage of fasteners interengaging the opposing frame members to place a clamping load onto the screening material trapped between the frame members, one such fastener being representatively shown.
Figure 3:
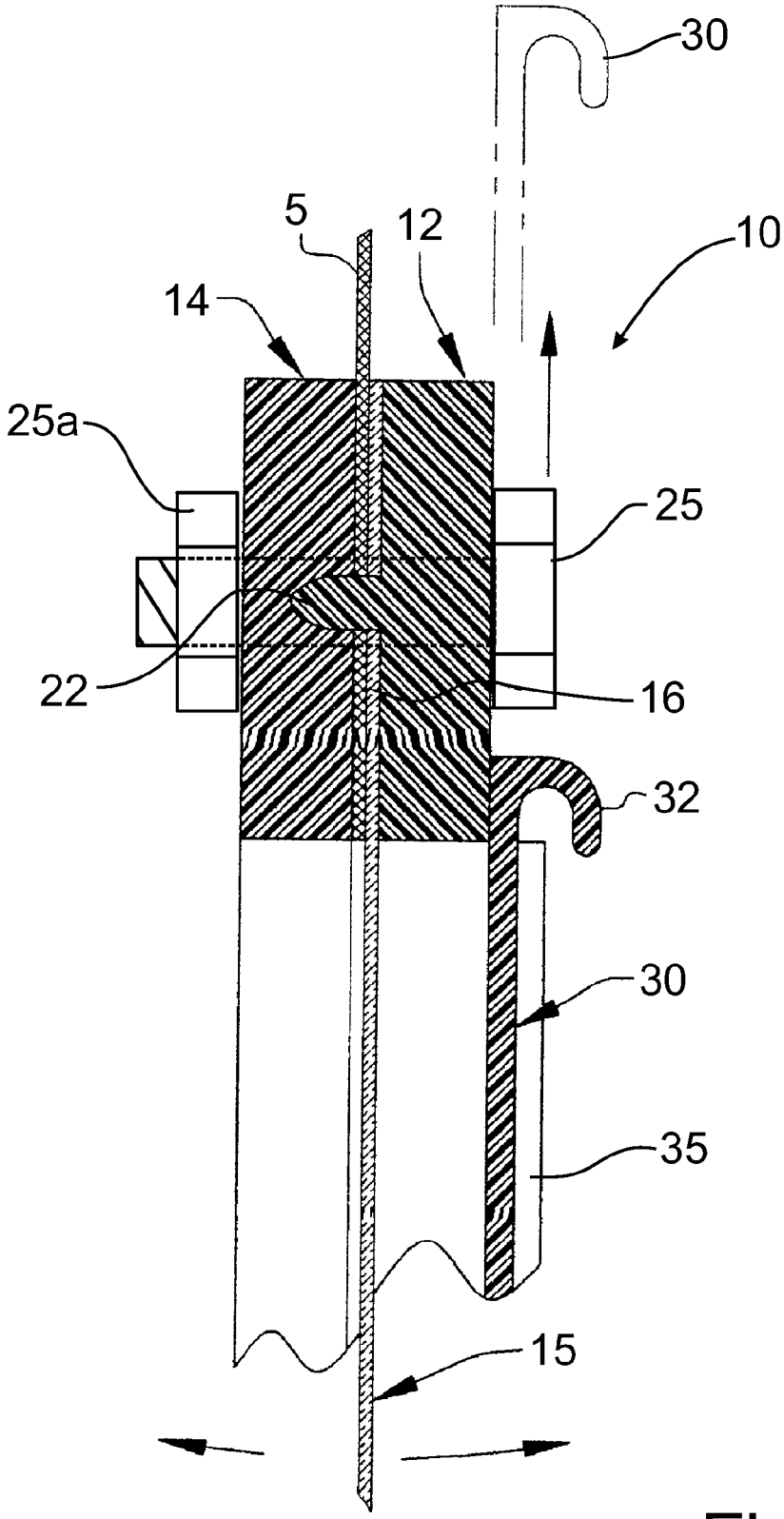
FIG. 3 is a partial cross-sectional view of the pet door assembly corresponding to lines 3-3 in FIG. 1, except that the security panel is shown received in the grooved receptacle formed on the inside of the inner frame member, the movement of the security panel being shown in phantom.
Figure 4:
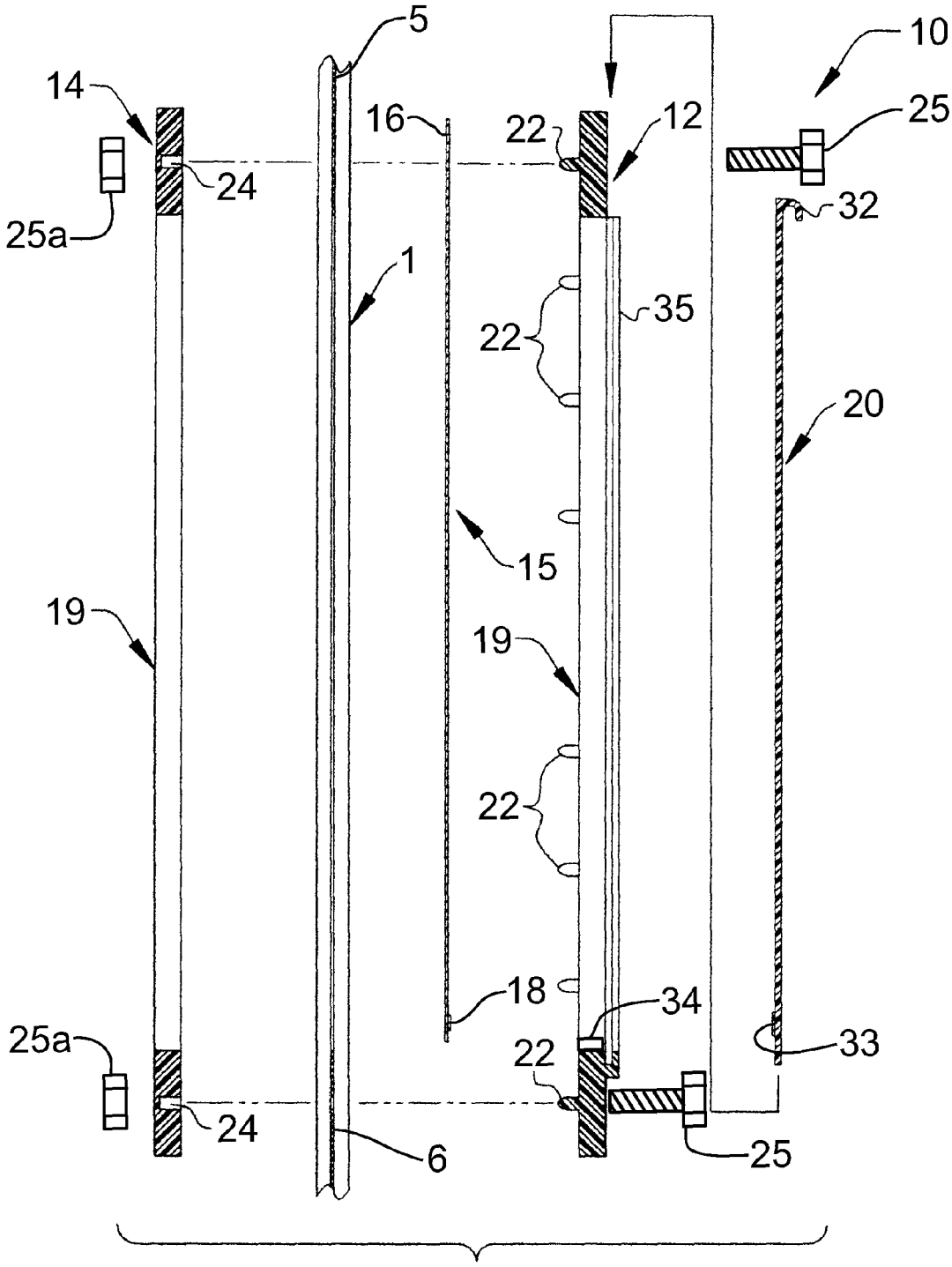
FIG. 4 is an exploded vertical cross-sectional view through a snap pin near the center of the pet door assembly, including the security panel, representative fastener members being depicted at the top and bottom of the assembly.

As best seen in FIGS. 2-4, the pet door assembly 10 is formed with a pair of mating inner and outer frame members 12, 14 with a pliable door flap 15 secured between the frame members 12, 14 when installed as will be described in greater detail below. One of the frame members 12, 14, depicted in the drawings as the inner frame member 12, is formed with a plurality of snap pins 22 spaced around the perimeter of the inner door frame 12. These snap pins 22 are engagable with corresponding bores 24 formed in the opposing outer frame member 14 such that the snap pins 22 pass into the bores 24 to lock the two frame members 12, 14 together. The snap pins 22 are capable of passing through the woven screening material 6 to reach the bores 24 on the opposing frame member 14, thus securing the frame members 12, 14 onto the screen member 5 around the entire perimeter of the frame members 12, 14.

To further secure the frame members 12, 14 onto the screen member 5, a plurality of fasteners 25, 25*a* are utilized around the perimeter of the frame members 12, 14. Preferably, eight such fasteners 25, 25*a* are utilized by positioning the fasteners 25, 25*a* at the respective corners of the frame members 12, 14 and at the mid-points of the respective sides of the frame members 12, 14. Both of the frame members 12, 14 are provided with fastener openings 26 at the appropriate locations on the frame members 12, 14 for the passage of the corresponding fasteners 25. One skilled in the art will recognize that either more or even fewer fasteners can be utilized, depending on the size of the frame members 12, 14. The pet door assembly 10 can be provided in multiple sizes corresponding to sizes of pets to be passing through the passageway 19, including small, medium and large assemblies 10. The purpose of the fasteners 25, 25*a* is to place a substantial clamping load onto the screening material 6 trapped between the frame members 12, 14 because the frame members 12, 14 are intended to be engaging screening material 6 entirely around the perimeter of the frame members 12, 14.

The door flap 15 is preferably formed with as a solid pliable sheet, such as from a thick vinyl material, so that the door flap 15 is not repugnant to the nose of the pet to be using the door assembly 10 for passage through the screen door 1. The door flap 15 is formed with an enlarged top portion 16 that is sized to correspond to the top sides of the frame members 12, 14. Accordingly, the top portion 16 is formed with holes 24*a* for the passage of the snap pins 22 and with openings 26*a* for the passage of the fasteners 25 interengaging the opposing frame members 12, 14. Thus, the top portion 16 is clamped between the opposing frame members 12, 14 by the snap pins 22 and the fasteners 25, 25*a*. The flexible nature of the pliable door flap 15 will allow the lower portion 17, which is sized to correspond to the passageway 19 through the frame members 12, 14, to hinge back and forth and allow the passage of the pet P through the passageway 19.

The inner frame member 12 corresponds to the interior of the dwelling structure D, while the outer frame member 14 is positioned on the exterior of the screen door 1. The inner frame member 12 is formed on the interior side thereof with a grooved receptacle 35 that is open upwardly at the top thereof. A security panel 30 is formed to be received within the grooved receptacle 35 and selectively removable by sliding the security panel 30 out of the top of the receptacle 35. The security panel 30 is preferably formed with a handle 32 at the top thereof to facilitate the handling and movement of the security panel 30. Once installed into the grooved receptacle 35, the security panel 30 blocks the passageway 19 to prevent the passage of the pet P through the door assembly 10.

Preferably, the body portion 31 of the security panel 30 is formed with a magnetic strip 33, or in the alternative with a ferrous metal strip that will attract a magnet. Similarly, the body portion 17 of the door flap 15 is preferably formed with a magnetic strip 18 that would be attracted to the magnetic or metal strip 33 in the bottom of the security panel 30. Thus, when the security panel 30 is installed into the grooved receptacle 35, the bottom of the door flap 15 will be magnetically latched against the security panel 30 to prevent casual movement thereof. Furthermore, the inner frame member 12 can be formed with a magnetic or metal strip 34 that will attract the magnetic strip 18 in the door flap 15 so that the door flap 15 will be encouraged to remain at a vertical position blocking the passageway 19 to insects, etc.

Preferably, the frame members 12, 14 and the security panel 30 are molded from plastic, such as by injection molding, to provide a lightweight, yet sufficiently strong frame structure for the door assembly 10. The snap pins 22 are preferably molded into the inner frame member 12, while the holes 24 are also preferably molded into the outer frame member 14 and the openings 26 are molded into both the inner and outer frame members 12, 14. The pliable door flap 15 is preferably formed of a sheet of vinyl and would have a thickness of about an eighth of an inch. The security panel 30 could be made of a lightweight, and light gauge metal, such as aluminum, but weight hanging on the screen member 5 is a limiting factor.

Installation of the pet access door assembly 10 on the screen member 5 of the outer screen door 1 is accomplished by placement of the door flap 15 on the snap pins 22 on the inner frame member 12. The inner frame member 12 can be aligned on the screen member 5 and secured in place by engaging the outer frame member 14 onto the snap pins 22 on the opposing side of the screen member 5 from the inner frame member 12. The snap pins 22 become engaged into the holes 24 in the outer frame member 14 to snap fit the inner and outer frame members 12, 14 together. To provide sufficient clamping forces to allow the mounting of the frame members 12, 14 onto the screen member 5 around the entire perimeter of the frame members 12, 14, fasteners 25 are inserted into the openings 26 in the inner frame member 12 and forced through the screening material 6 and then through the openings 26 in the outer frame member 14. A nut 25*a* engaged on the fastener 25 will assert a substantial clamping load onto the screening material 6 by the frame members 12, 14. The screening material around the inner periphery of the outer frame member 14 can then be cut to create the open passageway 19 through the door assembly 10.

Once installed, the pet P will push its nose against the soft pliable door flap 15 and push the door flap 15 outwardly to pass through the passageway 19. The return of the pet P, as is depicted in FIG. 1 is accomplished in the same manner, except that the door flap is pushed inwardly for the passage of the pet P back into the house D through the screen door 1. After the pet P has passed through the door assembly 10, the door flap 15 returns to the initial vertical position, enhanced by the attraction of the magnetic strip 18 in the door flap to the magnetic or metal strip 34 in the bottom of the inner frame member 12.

If utilization of the pet door assembly 10 is desired, the security panel 30 is positioned into the grooved receptacle 35, blocking the passageway 19 with a non-hinged member. The magnetic strip 18 in the door flap 15 is attracted to the magnetic or metal strip 33 in the bottom of the security panel 30 to secure the door flap 15 against the security panel 30 so that wind or animals cannot dislodge the door flap 15 when the security panel 30 is in place within the grooved receptacle 35. With the security panel 30 in position, the pet P cannot push the door flap 15 open or pass through the passageway 19. When operation is again desired, the security panel 30 is retracted from the grooved receptacle 35, the door flap 15 disengaged from the magnetic latch, and the door assembly is free for continued operation.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A pet access door assembly for mounting on a screen door having a screen member and an opening in said screen member and providing a pet-accessible opening through the screen door, comprising:

a first frame member having a top portion, a bottom portion and side portions defining a perimeter thereof, said first frame member being positioned on one side of said screen member and defining a central opening through a central portion thereof, said first frame member being formed with a plurality of pins projecting generally perpendicularly from said first frame member around said perimeter thereof, said first frame member also being formed with a plurality of fastener openings spaced around said perimeter thereof, said first frame member including a grooved receptacle formed on an outer surface thereof;

a second frame member having a top portion, a bottom portion and side portions defining a perimeter thereof, said second frame member being positioned on a side of said screen member opposite said one side of said screen member, said second frame member mating with said first frame member and including a central opening alignable with said central opening in said first frame member, said second frame member being formed with a plurality of holes positioned around said perimeter of said second frame member to be alignable with said pins projecting from the first frame member, said perimeter of said second frame member further being formed with a plurality of fastener openings alignable with said fastener openings in said first frame member;

a solid pliable sheet having a top edge portion formed with a plurality of holes alignable with corresponding said holes in said perimeter of said second frame member and corresponding said pins on said perimeter of said first frame member, said pliable sheet including at least one fastener opening alignable with at least one corresponding said fastener opening in each of said first and second frame members, said pliable sheet further having a body portion extending downwardly from said top edge portion, said body portion having a size and shape corresponding to said central openings in said first and second frame members, said body portion being positioned adjacent to said screen member so as to form an extension of said screen member and to be movable relative to said first and second frame members for passage of a pet through said central openings;

a security panel slidably mounted within said grooved receptacle and being movable between an open position in which said pet can pass through said central opening in said first frame member and a closed position in which said central opening in said first frame member is covered by said security panel to prevent said pet from passing through said central openings, said security panel being formed with a magnetic attraction member at a bottom portion of said security panel, said magnetic attraction member attracts a magnetic strip in a bottom portion of said body portion of said pliable sheet when said security panel is moved to said closed position; and fasteners passing through aligned said fastener openings in said first and second frame members to clamp said first and second frame members together with said screen member being located between said first and second frame members and with said pins passing through said screen member to support said first and second frame members on said screen door, said fasteners applying a clamping load on said screen member through said first and second frame members.

2. The pet access door assembly of claim 1 wherein said first and second frame members are molded from plastic.

3. A pet access door assembly for mounting on a screen door, said screen door having a frame and a screen member having an opening, said pet access door assembly cooperating with said opening in said screen member to provide a pet door on said screen door for ingress and egress of a pet through said screen door, comprising:

an outer frame member having a perimeter and having a central opening therethrough, said outer frame member being formed with a plurality of fastener openings spaced around said perimeter thereof;

an inner frame member having a perimeter corresponding to said perimeter of said outer frame member, said inner frame member including a central opening registrable with said central opening in said outer frame member, said inner frame member being formed with a plurality of fastener openings spaced around said perimeter thereof, said fastener openings of said inner frame member being alignable with said fastener openings in said outer frame member, said inner frame member further including a grooved receptacle on an outside surface of said inner frame member;

a plurality of snap pins projecting generally perpendicularly from one of said frame members, the other of said frame members being formed with a plurality of holes alignable with said snap pins, said snap pins passing through said screen member and into said plurality of holes to help support said outer and inner frame members on said screen member;

a pliable sheet having a top edge portion alignable with an upper side of each of said inner and outer frame members and a body portion extending downwardly from said top edge portion, said body portion having a size and shape corresponding to said central openings in said outer and inner frame members, said body portion being movable relative to said inner and outer frame members for passage of said pet through said central openings in said outer and inner frame members, said top edge portion being formed with holes receiving said snap pins, said top edge portion further being formed with at least two fastener openings therein alignable with corresponding said fastener openings in said outer and inner frame members;

a security panel slidably mounted within said grooved receptacle and being movable between an open position in which said pet can pass through said central opening in said inner frame member and a closed position in which said central opening in said inner frame member is covered by said security panel to prevent said pet from passing through said central openings, said security panel being formed with a magnetic attraction member at a bottom portion of said security panel, said magnetic attraction member attracts a magnetic strip in a bottom portion of said body portion of said pliable sheet when said security panel is moved to said closed position; and a plurality of fasteners passing through aligned corresponding said fastener openings in said outer and inner frame members to interengage said outer and inner frame members and apply a clamping load on said screen member, said top edge portion of said pliable sheet being clamped between said outer and inner frame members by at least two of said fasteners and being positioned adjacent said screen member so that said pliable sheet forms an extension of said screen member.

4. The pet access door assembly of claim 3 wherein said holes in said top edge portion of said pliable sheet are alignable with corresponding said holes in said other frame member and said pins.

5. A combination of a screen door and a pet access door assembly supportable on said screen door having a screen member and an opening in said screen member to provide a passageway through said screen door for ingress and egress of a pet through said screen door, the combination comprising:

an outer frame member having a generally rectangular perimeter and having a central opening therethrough in register with said opening in said screen member, said outer frame member being formed with a plurality of fastener openings spaced around said perimeter thereof to receive fasteners therethrough, said outer frame member also being formed with a plurality of holes spaced around said perimeter thereof;

an inner frame member having a generally rectangular perimeter mating with said perimeter of said outer frame member and including a central opening registrable with said central opening in said outer frame member, said inner frame member being formed with a plurality of fastener openings alignable with said fastener openings in said outer frame member to receive said fasteners therethrough to clamp said inner and outer frame members together on opposite sides of said screen member and apply a clamping load on said screen member, said inner frame member being formed with a plurality of pins projecting outwardly around said perimeter thereof in register with said holes in said outer frame member, said pins passing through said screen member and into said holes of said outer frame member to help support said inner and outer frame members on said screen member;

a solid pliable sheet having a top edge portion clamped between a top side of each of said inner and outer frame members and a body portion extending downwardly from said top edge portion, said body portion having a size and shape corresponding to said central openings in said outer and inner frame members, said body portion being movable relative to said outer and inner frame members to permit said pet to pass through said passageway, said top edge portion being formed with a plurality of holes for the passage of said pins corresponding to said top side of said inner frame member and with at least two fastener openings alignable with corresponding said fastener openings in said outer and inner frame members, said top edge portion being attached to said screen member so that said body portion of said pliable sheet forms an extension of said screen member, said body portion including a magnetic strip along a bottom portion thereof; and a rigid security panel movably mounted on said inner frame member and being movable between an open position in which said pet can pass through said passageway and a closed position in which said passageway is covered by said security panel to prevent said pet from passing through said passageway, said rigid security panel being formed with a magnetic attraction member in a bottom portion thereof that attracts said magnetic strip in said body portion when said security panel is in said closed position.

6. The combination of claim 5 wherein said inner frame member is formed with a grooved receptacle to receive said security panel, said security panel being slidable along said grooved receptacle for movement between said open position and said closed position.

* * * * *